US005763009A

United States Patent [19]

Kegasawa et al.

[11] Patent Number: 5,763,009

[45] Date of Patent: Jun. 9, 1998

[54] PROCESS FOR PRODUCING SUPPORT FOR RECORDING MATERIAL

[75] Inventors: Tadahiro Kegasawa; Kazuo Ozaki; Kunio Takahashi; Katsuhiko Takada, all of Shizuoka, Japan

[73] Assignee: Fuji Photo Film Co., Ltd., Kanagawa, Japan

[21] Appl. No.: 708,670

[22] Filed: Sep. 5, 1996

[30] Foreign Application Priority Data

Sep. 5, 1995 [JP] Japan ..... 7-227823

[51] Int. Cl.[6] ..... B05D 3/12

[52] U.S. Cl. ..... 427/366; 427/326; 427/361; 162/177

[58] Field of Search ..... 427/326, 358, 427/361, 365, 366; 162/177

[56] References Cited

U.S. PATENT DOCUMENTS 4,166,758 9/1979 Watanabe et al. ..... 162/117
5,360,657 11/1994 Kano et al. ..... 428/207
5,547,822 8/1996 Noda et al. ..... 430/531

FOREIGN PATENT DOCUMENTS 0 391 430 10/1990 European Pat. Off. ..... G03C 1/775
1-43079 9/1989 Japan ..... D21G 1/00
2-264940 10/1990 Japan ..... G03C 1/775
6-266047 9/1994 Japan ..... G03C 1/79

*Primary Examiner*—Brian K. Talbot
*Attorney, Agent, or Firm*—Sughrue, Mion, Zinn, Macpeak & Seas, PLLC

[57] ABSTRACT

Improved process for producing a support for recording material comprising the steps of calendering a base paper including 1.8%–10.0% water content under nip pressure from 400 kg/cm to 3000 kg/cm at the roller temperature from 10° C. to 140° C., and extusion coating the base paper with melted thermoplastic resin is proposed. The support produced by the process is superior in surface smoothness and glossiness. Upon using it for a recording material, excellent image with less unevenness can be obtained without using heat calendering at excessively high temperature after the coating.

11 Claims, 1 Drawing Sheet

PROCESS FOR PRODUCING SUPPORT FOR RECORDING MATERIAL

BACKGROUND OF THE INVENTION

This invention relates to a process for producing a paper-based support coated with resin of which smoothness is remarkably improved by very high pressure calendering, especially relates to a process for producing a support for photographic paper, a support for heat-sensitive recording material or paper for various printers which requires high smoothness.

A known process for producing a support for recording material is disclosed in Japanese Patent KOKOKU 1-43079 which is a process for producing a support for photographic paper which comprises calendering with heating a base paper having 1.8%–7.0% bone-dry water content by passing between two metal nip rollers at a temperature from 150° C. to 300° C. and a line pressure from 40 kg/cm to 150 kg/cm. An improvement thereof is disclosed in Japanese Patent KOKAI 6-266047 which comprises calendering a base paper by passing between two metal nip rollers at a temperature of 200° C. or more and a nip pressure from 40 kg/cm to 200 kg/cm under the condition that the front side of the base paper contacts the roller having a surface temperature from 120° C. to 300° C., and within 300 seconds coating the base paper with polyolefin resin. Although these process were developed in order to improve smoothness and stiffness, the polyolefin resin coating must be done quickly after calendering because of returning of fibers located on the surface of base paper will degrade smoothness. Moreover, the high temperature calendering brings heat deterioration of paper quality and deterioration by the escape of water content. Equipment cost and energy cost spent by heating are also problems.

As a process for producing a support for photographic paper of which both surfaces are coated with polyolefin resin, a process which comprises calendering a base paper by passing between two metal rollers followed by passing between a metal roller and a synthetic resin roller is known (Japanese Patent KOKAI 2-203335, 4-81836). Another process for producing a support for photographic paper of which both surfaces are coated with polyolefin resin comprises moistening a base paper which has been dried after paper-making process by the mist method, and then calendering between metal rollers heated at 70° C. –200° C. (Japanese Patent KOKAI 2-264940). Although these processes were developed in order to eliminate wavy large irregularities and dot-formed small irregularities to obtain a smooth surface, density of the base paper after calendering was only 1.08 g/cm$^3$ at the maximum. Accordingly, it was desired to develop a process capable of providing a paper support having higher smoothness inexpensively.

SUMMARY OF THE INVENTION

An object of the invention is to provide a process for producing a support for a recording material, such as photographic paper, heat-sensitive recording material or paper for various printers, capable of forming images with high quality by the improvement in surface smoothness to decrease image unevenness upon or after printing and color development.

The present invention provides a process for producing a support for a recording material which has achieved the above described object, which comprises calendering a base paper having 1.8%–10% water content under nip pressure from 400 kg/cm to 3,000 kg/cm at a roller temperature from 10° C. to 140° C. and then extrusion coating the base paper with melted thermoplastic resin.

DETAILED DESCRIPTION OF THE INVENTION

Figure 1:
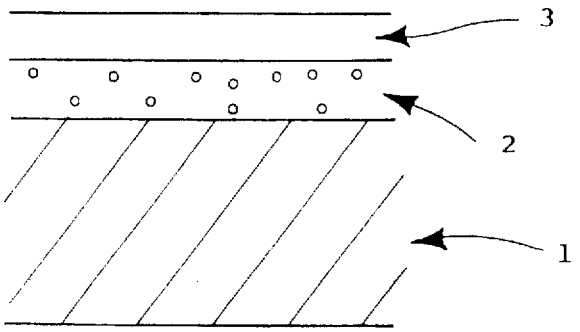
FIG. 1 is a partial sectional view of a recording material produced by forming a photosensitive material layer on the surface of the support obtained by the process of the invention.

In FIG. 1, a base paper 1 to which the invention is applied is obtained by paper-making a material containing natural pulp selected from softwood pulp, hardwood pulp, etc. as the principal raw material and additives which will be described later. Synthetic pulp may be used instead of the natural pulp, and a mixture of natural pulp and synthetic pulp in an arbitary mixing ratio is also usable. It is preferable to use hardwood pulp which is short fiber pulp in an amount of 60 wt. % or more of the total pulp. A preferable degree of beating of the pulp is from 200 to 500 cc Canadian Standard Freeness (C.S.F.), more preferably from 250 to 350 cc C.S.F.

Additives for the paper material are fillers, such as clay, talc, calcium carbonate and area resin particles, sizing agent, such as rosin, alkyl ketene dimer, higher fatty acid salt, paraffin wax and alkenyl succinic acid anhydride, paper resinforcing agent, such as polyacrylamide, fixing agent, such as aluminum sulfate and aluminum chloride, and the like. In addition, dye, fluorescent dye, slime-controlling agent, antifoamer, etc. may be added. Especially, by adding the following softening agent, the invention can be improved effectively.

The softening agent can be selected from disclosure in "Shin•Kamikako-Binran (New•Paper Processing Handbook)", pages 554–555, Shigyo Times, 1980. Preferable softening agents have a molecular weight of 200 or more, especially those having a hydrophobic group having a number of carbon atoms of 10 or more and an amine salt or a quaternary ammonium salt having self-fixing ability to cellulose. Examples are reaction products of maleic anhydride copolymer and polyalkylene-polyamine, reaction products of higher fatty acid and polyalkylene-polyamine, reaction products of urethane alcohol and alkylating agent, quaternary ammonium salt of higher fatty acid, etc., and particularly ones are reaction products of maleic anhydride copolymer and polyalkylene-polyamine and reaction products of urethane alcohol and aikylating agent.

The surface of the base paper may be treated with surface sizing by a film-forming polymer, such as gelatin, starch, carboxymethyl cellulose, polyacrylamide, polyvinyl alcohol or modified polyvinyl alcohol. Exemplary modified polyvinyl alcohols are carboxyl group modified polyvinyl alcohol, silanol modified polyvinyl alcohol, copolymers of polyvinyl alcohol and acrylamide, and so on. A suitable coating amount of the film-forming polymer for surface sizing is from 0.1 to 5.0 g/m$^2$, preferably from 0.5 to 2.0 g/m$^2$. To the film-forming polymer, antistatic agent, fluorescent brightener, filler, antifoamer and the like may optionally be added.

The base paper is produced by paper-making the aforementioned pulp slurry containing pulp and optional additives, such as filler, sizing agent, paper-reinforcing agent and fixing agent, using a paper machine, such as Wire paper machine, drying, and then winding up. The above surface sizing is conducted before or after the drying.

In the above drying process, the water content of the base paper is adjusted to 1.8%–10%, preferably 3%–9%, more preferably 5%–8% by weight. When the water content is less than 1.8%, calendering effects are insufficient. When the water content is greater than 10%, fiber collapse, transparentizing, calender fouling, and the like tend to occur.

Calendering is carried out between the drying step and the winding step or between the winding step and the laminating step of a thermoplastic resin. The calendering is conducted by passing between two metal rollers, and in the process of the invention, surface temperature of both rollers is settled to be from 10° C. to 140° C., preferably from 20° C. to 100° C., more preferably from 20° C. to 80° C. When the roll temperature is higher than 140° C., paper quality becomes unstable by the evaporation of moisture to vary the water content of base paper or to render surface rough. When the roller temperature is lower than 10° C., a means for cooling the rollers is necessary. The calendering nip pressure is from 400 to 3,000 kg/cm, preferably from 1,000 to 2,500 kg/cm, more preferably from 1, 500 to 2,000 kg/cm. When the nip pressure is less than 400 kg/cm, the improvement in surface smoothness is insufficient. When the nip pressure is more than 3,000 kg/cm, the improvement of smoothness by the excess nip pressure becomes small. By the calendering, the base paper density becomes about 1.1 g/cm$^3$–1.4 g/cm$^3$, usually 1.2 g/cm$^3$–1.3 g/cm$^3$, and the surface roughness of base paper becomes about 0.7 μm–1.0 μm, usually 0.7 μm–0.8 μm.

When surface sizing is conducted after drying, the calendering may be carried out either before or after the surface sizing. However, the calendering according to the invention is preferably carried out in the finishing process after various treatments have been conducted.

After the calendering, the thermoplastic resin layer 2 is applied on at least one surface of the base paper by extrusion coating. Preferable thermoplastic resins are polyolefin resins. Exemplary polyolefin resins are a α-olefin homopolymers, such as polyethylene and polypropylene, and mixture of the α-olefin homopolymers. Particularly polyolefin resins are high density polyethylene resins, low density polyethylene resins and mixtures thereof. Molecular weight of the polyolefin resin is not especially limited within the range capable of conducting extrusion coating, and usually in the range from 20,000 to 200,000.

The thickness of the thermoplastic resin layer is not especially limited, and is designed according to the thickness of the thermoplastic resin coating layer of a conventional support for a recording material. A usual thickness of the thermoplastic resin layer is from 15 μm to 50 μm.

To the thermoplastic resin layer, known additives, such as white pigment, color pigments, fluorescent brightener and antioxidant, may be added. Particularly, it is preferable to add white pigment or a color pigment to the thermoplastic resin coating layer onto which a photographic emulsion or the like is coated.

The extrusion coating apparatus for coating the thermoplastic resin may be a conventional thermoplastic resin extruder and a conventional coater.

By calendering the base paper at a very high pressure, a support with excellent smoothness can be produced. Glossiness is also improved. When a photosensitive material is produced by coating the thermoplastic resin onto the support (base paper) followed by coating a photosensitive emulsion thereonto, excellent surface conditions with small image unevenness can be obtained. Moreover, surface defects of small indentation (pits) generated on the resin coated surface can be reduced.

Since very smooth surface equivalent to or superior to the surface calendered by heat calendering can be obtained at ordinary temperature, the variation (decrease) of the base paper water content does not occur, and water content control of the base paper is easy.

EXAMPLES

A wood pulp composed of 60 parts by weight of LBKP, 40 parts by weight of LBSP was beated up to 300 cc of Canadian freeness by a disc refiner, and 0.5 part of epoxidized behenic amide, 1.0 part of anionic polyacrylamide, 1.0 part of aluminum sulfate, 0.5 part of cationic polyacrylmide and 0.1 part of polyamide-polyamine epichlorohydrin were added to the beaten pulp by the bone dry weight ratio to the wood pulp. Using the pulp slurry, a base paper having an areal weight of 125 g/m$^2$ and a water content of 6.0 % was made by a wire paper machine.

The base paper was subjected to very high pressure calendering under the conditions shown in Table 1.

Subsequently, polyethylene (PE) resin having a melt index of 3 and a density of 0.94 containing 10 wt. % $TiO_2$ was applied onto a surface of the base paper by the extrusion coating under the following conditions to prepare a support (PE resin layer thickness : 30 μm).

| Extrusion Coating Conditions | |
|---|---|
| Extruder Screw Diameter: | 2.5 inch |
| Coating Speed: | 100 m/min |
| Corona Discharge Voltage before Coating: | 3 KV |
| Extrusion Temperature | 300° C. |
| Cooling Roller Temperature | 15° C. |

The surface roughness of the base paper was determined by measuring a centerline average height (Ra) at wavelengths of not longer than 1.6 mm using a surface roughness tester ("Surfcom 570 A", Tokyo Seimitsu).

A color heat-sensitive recording layer was applied on the PE resin layer, and was dried to form a recording material. The recording material was printed using a heat-sensitive paper printer ("Photo Joy Printer NC-1", Fuji Photo Film Co., Ltd.), and surface conditions thereof were evaluated by visual observation (sensory test). The evaluation of surface conditions was conducted mainly as to color unevenness (density unevenness) at single color portions and gray portions. The best point was 10 points, and higher points than 5 indicate the better surface conditions with less image unevenness.

The calendering conditions and evaluated results are shown in Table 1.

TABLE 1

| | Comparative Ex. | Inventive Ex. | | | | |
|---|---|---|---|---|---|---|
| | 1 | 1 | 2 | 3 | 4 | 5 |
| Base Paper Areal Weight (g/m$^2$) | 125 | 125 | 125 | 125 | 125 | 125 |
| Base Paper Water Content (%) | 6.0 | 6.0 | 6.0 | 1.0 | 11.0 | 6.0 |
| Calender Nip Pressure (kg/cm) | 100 | 500 | 1000 | 1000 | 1000 | 1000 |
| Calender Temperature (°C.) | 20 | 20 | 20 | 20 | 20 | 150 |
| Calender Speed (m/min) | 20 | 20 | 20 | 20 | 20 | 20 |
| Density after Calendering (g/cm$^3$) | 1.00 | 1.22 | 1.31 | 1.19 | 1.29 | 1.28 |

TABLE 1-continued

| | Comparative Ex. | Inventive Ex. | | | | |
|---|---|---|---|---|---|---|
| | 1 | 1 | 2 | 3 | 4 | 5 |
| Base Paper Surface Roughness Ra (μm) | 1.2 | 0.9 | 0.7 | 1.0 | 0.8 | 0.8 |
| Evaluation of Surface Conditions (Sensory Test) | 5 | 7 | 9 | 6 | 8 | 8 |

From the results shown in Table 1, it can be seen that, by the very high pressure calendering of the invention, various effects are ob tained, such as increase of density, decrease of surface roughness, improvement in surface conditions after printing of thermal recording material (Comparative Example 1, Inventive Examples 1, 2).

Subsequently, using the same base paper as above, the very high pressure calendering was conducted under the conditions shown in Table 2 to prepare the supports, and then, the same PE resin containing $TiO_2$ was applied on a surface of the base paper under the same conditions as described above except the thickness. The color heat-sensitive recording layer to form another recording material was applied on the FE resin layer, and dried. The recording material was printed using the heat-sensitive printer, and surface conditions thereof were evaluated by visual observation (sensory test).

The calendering conditions and evaluated results are shown in Table 2.

TABLE 2

| | Comparative Ex. | | Inventive Ex. | |
|---|---|---|---|---|
| | 2 | 3 | 6 | 7 |
| Base Paper Areal Weight (g/m$^2$) | 125 | 125 | 125 | 125 |
| Base Paper Water Content (%) | 6.0 | 6.0 | 6.0 | 1.0 |
| Calender Nip Pressure (kg/cm) | 0 | 0 | 1000 | 1000 |
| Calender Temperature (°C.) | 25 | 25 | 25 | 25 |
| Calender Speed (m/min) | 20 | 20 | 20 | 20 |
| PE Layer Thickness (μm) | 30 | 60 | 30 | 60 |
| Evaluation of Surface Conditions (Sensory Test) | 5 | 7 | 9 | 10 |

From the results shown in Table 2, it can be seon ithat, by the very high pressure calendering of the invention, surface conditions are improved by the improverment in surface smoothness, the thicker coating thickness brings the better surface conditions, and the surface conditions are further improved by the effects of the very high pressure calendering (Examples 6, 7).

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

We claim:

1. A process for producing a support for recording material comprising:

calendering a base paper including 1.8 % –10.0 % by weight water content under nip pressure from 1000 kg/cm to 3000 kg/cm at a roller temperature from 10° C. to 140° C. to obtain a calendered base paper naving a density of 1.1 to 1.4 g/cm$^3$, and extrusion coating a melted thermoplastic resin on the base paper.

2. A process as claimed in claim 1, wherein pulp is used to make the base paper and the degree of beating of the pulp used for the base paper is 200 cc–500 cc Canadian Standard Freeness.

3. A process as claimed in claim 1, wherein the base paper contains a softening agent having a molecular weight of 200 or more.

4. A process as claimed in claim 3, wherein the softening agent has 1) a hydrophobic group having a number of carbon atoms of 10 or more and 2) an amine salt or a quarternary ammonium salt having self-fixing ability to cellulose.

5. A process as claimed in claim 1, wherein the base paper has a surface which has been sized by applying a film-forming polymer.

6. A process as claimed in claim 1, wherein said water content of the base paper is 4.0% to 9.0% by weight.

7. A process as claimed in claim 1, wherein said nip pressure is from 1,000 kg/cm to 2,500 kg/cm.

8. A process as claimed in claim 1, wherein said roller temperature is from 20° C. to 100° C.

9. A process as claimd in claim 1, wherein said thermoplastic resin is polyolefin resin containing white pigment.

10. A process as claimed in claim 1, wherein the calendered base paper has a surface roughness of 0.7 to 1.0 μm.

11. A process for producing a support for recording material comprising:

calendering a base paper including 1.8%–10.0% by weight water content under nip pressure from 400 kg/cm to 3000 kg/cm at a roller temperature from 10° C. to 140° C. to obtain a calendered base paper having a density of 1.1 to 1.4 g/cm$^3$ and a surface roughness of 0.7 to 1.0 μm, and extrusion coating a melted thermoplastic resin on the base paper.

* * * * *